US008925918B2

(12) United States Patent
Kiuchi

(10) Patent No.: US 8,925,918 B2
(45) Date of Patent: Jan. 6, 2015

(54) CONVEYING APPARATUS

(75) Inventor: Takahiro Kiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/550,812

(22) Filed: Jul. 17, 2012

(65) Prior Publication Data

US 2013/0043641 A1 Feb. 21, 2013

(30) Foreign Application Priority Data

Aug. 16, 2011 (JP) ..... 2011-177862

(51) Int. Cl.
*B65H 5/00* (2006.01)
*B65H 85/00* (2006.01)

(52) U.S. Cl.
CPC ..... *B65H 85/00* (2013.01); *B65H 2301/33312* (2013.01); *B65H 2403/481* (2013.01); *B65H 2404/14* (2013.01); *B65H 2513/104* (2013.01); *B65H 2513/41* (2013.01); *B65H 2801/06* (2013.01); *B65H 2301/33214* (2013.01)
USPC ..... 271/225; 271/270; 271/184; 271/186

(58) Field of Classification Search
USPC ..... 271/270, 186, 184, 225, 902, 272–274; 399/401, 364
See application file for complete search history.

(56) References Cited

U.S. PATENT DOCUMENTS

| | | | | |
|---|---|---|---|---|
| 6,471,202 | B1 * | 10/2002 | Sugimura | 271/10.11 |
| 7,533,878 | B2 | 5/2009 | Cook et al. | |
| 8,038,144 | B2 * | 10/2011 | Hara | 271/186 |
| 2006/0239734 | A1 * | 10/2006 | Ohtsuki | 399/401 |
| 2006/0269339 | A1 * | 11/2006 | Okamoto et al. | 399/401 |
| 2007/0057447 | A1 * | 3/2007 | Asada et al. | 271/272 |
| 2010/0301549 | A1 * | 12/2010 | Moriyama | 271/264 |
| 2012/0200027 | A1 * | 8/2012 | Korenaga | 271/3.19 |

* cited by examiner

*Primary Examiner* — Luis A Gonzalez
(74) *Attorney, Agent, or Firm* — Fitzpatrick, Cella, Harper & Scinto

(57) ABSTRACT

A conveying apparatus has a first conveying roller pair; a second conveying roller pair; a first conveying path through which a sheet is conveyed in such a manner that the first conveying roller pair is placed downstream of the second conveying roller pair; and a second conveying path through which the sheet is conveyed in such a manner that the first conveying roller pair is placed upstream of the second conveying roller path. A circumferential velocity of at least one of the first conveying roller pair and the second conveying roller pair is switched so as to meet conditions, i.e., $|V_a|>|V_b|$ when the sheet is conveyed through the first conveying path and $|V_a|\leq|V_b|$ when the sheet is conveyed through the second conveying path. Here, $|V_a|$ is an absolute value of the circumferential velocity of the first conveying roller pair, and $|V_b|$ is an absolute value of the circumferential velocity of the second conveying roller pair.

12 Claims, 6 Drawing Sheets

CONVEYING APPARATUS

BACKGROUND OF THE INVENTION

1. Field of the Invention

The present invention relates to a conveying apparatus that conveys sheets.

2. Description of the Related Art

Some of recording apparatuses that perform printing on a paper sheet have a conveying apparatus that substantially horizontally loads and holds paper sheets in a lower portion of a recording apparatus main body and carries out so-called U-turn sheet feeding, i.e., conveying a paper sheet along a substantially U-shaped conveying path (which may be referred to as a U-turn path in some cases) before performing printing on the paper sheet. In such a conveying apparatus is provided a sheet feeding roller pair arranged upstream of the conveying path or a conveying roller path arranged downstream of the conveying path. Further, to cope with conveyance of small-sized paper sheets, some conveying apparatuses have an intermediate roller pair arranged at a halfway point of the conveying path besides these roller pairs. These roller pairs rotate while nipping a paper sheet and carries the paper sheet.

In the conveying apparatus having such a configuration, an operation for correcting an inclination (a skew) of a paper sheet that occurs in a paper sheet conveying process may be performed. Specifically, during conveyance of a paper sheet using the intermediate roller pair, an end of the paper sheet that is being conveyed is arranged to abut on the conveying roller pair that is stopped or rotated in a reverse direction, and the end of the paper sheet is aligned with a nip line of the conveying roller pair, thereby correcting the skew of the paper sheet. This abutting operation enables correcting the inclination of the paper sheet at the end portion of the paper sheet. However, the intermediate roller pair that conveys the paper sheet keeps nipping in a state that a central portion or a rear portion of the paper sheet is inclined, whereby the paper sheet is twisted between the end of the paper sheet and the central portion or the rear portion of the paper sheet. When the skew of the end portion of the paper sheet is corrected, the conveying roller pair that is stopped or rotated in the reverse direction is rotated in a forward direction, the end of the paper sheet is nipped, and the paper sheet is conveyed, but this twist of the paper sheet can be a factor that again inclines the paper sheet to cause the skew of the paper sheet.

As a method for coping with this problem, as disclosed in U.S. Pat. No. 7,533,878, there is a method of using an intermediate roller pair having rollers (swing arm type rollers) disposed to an arm that swings around a fixed shaft. The swing arm type roller increases a nip pressure with an increase in conveying resistance from the paper sheet received by the rollers or reduces the nip pressure or releases the nip. Here, the nip pressure means a pressure that is applied to the nipped paper sheet from the roller pair. Further, when driving of the rollers is stopped immediately after correcting the inclination of the paper sheet so that the conveying resistance from the paper sheet is not received, the nip of the paper sheet can be released, and the torsion caused at the time of correcting the inclination of the paper sheet can be eliminated.

In a conveying apparatus for use in a recording apparatus typified by an ink jet recording apparatus in recent years, miniaturization and realization of a low cost are demanded. Therefore, it is desirable to drive the conveying roller pair and the intermediate roller pair by a single motor without providing different motors for these roller pairs. When both the roller pairs are driven by the single motor, it is difficult to stop driving the intermediate roller pair alone like U.S. Pat. No. 7,533,878.

Further, in the swing arm type roller, when a paper sheet nipped by a pair of rollers is pulled at a higher velocity than a circumferential velocity of the swing arm type roller, conveying resistance of the paper sheet is reduced or eliminated, and hence the nip of the paper sheet is released. In this case, when the circumferential velocity of the conveying roller pair on the downstream in the conveying direction is increased beyond the circumferential velocity of the intermediate roller pair on the upstream in the conveying direction, distortion caused at the time of correcting the skew of the paper sheet can be annihilated.

Some of recording apparatuses perform printing on both sides of a paper sheet. Such a recording apparatus has a conveying apparatus that can pass a paper sheet to another conveying path (which may be referred to as a reversing path in some cases) and again convey the paper sheet to a printing portion with the paper sheet being reversed after arranging a front side of the paper sheet to face the printing portion through the conveying path (a U-turn path) and effecting printing.

In the reversing path, the paper sheet can be conveyed from the conveying roller pair to the intermediate roller pair through a path different from the U-turn path and, in this case, the paper that has reached the intermediate roller pair is again conveyed to the conveying roller pair like the U-turn path. In this case, the conveying roller pair is placed on the downstream of the intermediate roller pair (see also FIG. 1A) in the U-turn path, but the conveying roller pair is placed on the upstream of the intermediate roller pair in the reversing path (see also FIG. 1B). Therefore, when the paper sheet is conveyed through one of the paths, a conveying velocity of the roller pair on the downstream is lower than a conveying velocity of the conveying roller pair on the upstream. As a result, in the roller pairs, the paper sheet adheres to the outer periphery of each path and then buckles, which results in a problem that a skew or a jam occurs.

SUMMARY OF THE INVENTION

As described above, in the swing arm type rollers, the circumferential velocity of the conveying roller pair is increased beyond the circumferential velocity of the intermediate roller pair having the swing arm type rollers. Therefore, when these roller pairs are driven by the single motor, changing a velocity relationship between both the roller pairs is difficult, and hence solving the above-described problem is important.

To solve the problem, a conveying apparatus according to a first invention comprises: a first conveying roller pair which rotates while nipping a sheet and conveys the sheet; a second conveying roller pair which rotates while nipping the sheet and conveys the sheet; a first conveying path through which the sheet is conveyed in such a manner that the first conveying roller pair is placed on the downstream of the second conveying roller pair; and a second conveying path through which the sheet is conveyed in such a manner that the first conveying roller pair is placed on the upstream of the second conveying roller pair. A circumferential velocity of at least one of the first conveying roller pair and the second conveying roller pair is switched so as to satisfy conditions, i.e., $|V_a|>|V_b|$ when the sheet is conveyed through the first conveying path and $|V_a|\leq|V_b|$ when the sheet is conveyed through the second conveying path. Here, $|V_a|$ is an absolute value of the circumferential velocity of the first conveying roller pair, and $|V_b|$ is an absolute value of the circumferential velocity of the second conveying roller pair.

According to the invention, when conveying the sheet through one of the first conveying path and the second conveying path, it is possible prevent the paper sheet from adhering to the outer periphery of each path and then buckling in the first and second conveying roller pairs, thereby avoiding occurrence of a skew or a jam.

Further features of the present invention will become apparent from the following description of exemplary embodiments with reference to the attached drawings.

BRIEF DESCRIPTION OF THE DRAWINGS

FIG. 1A shows a position of a paper sheet at the time of a regular path (a U-turn path) conveyance and FIG. 1B shows a position of the paper sheet at the time of reversing path conveyance.

DESCRIPTION OF THE EMBODIMENTS

Figure 2:
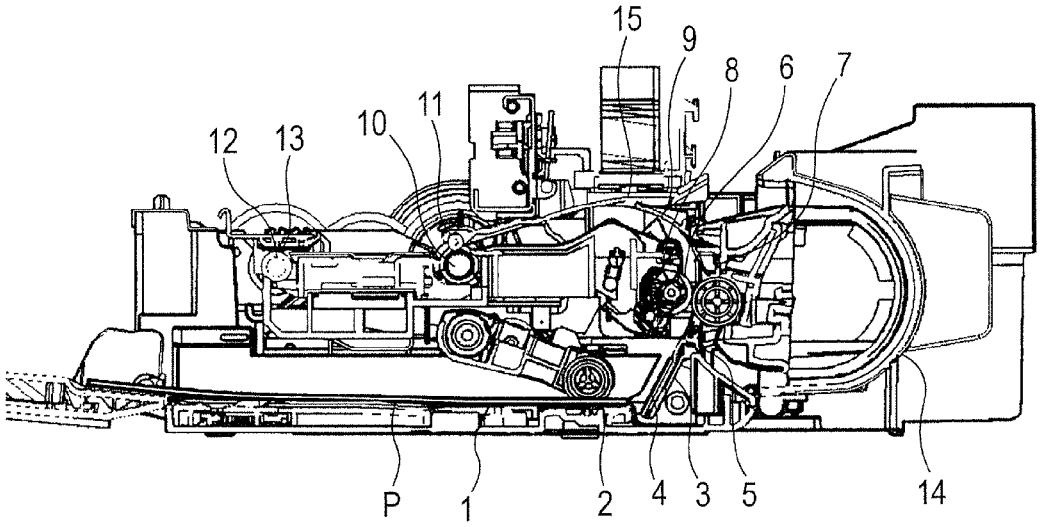
FIG. 2 is a longitudinal cross-sectional view showing an embodiment of a recording apparatus including the conveying apparatus to which the present invention is applied.
Figure 7:
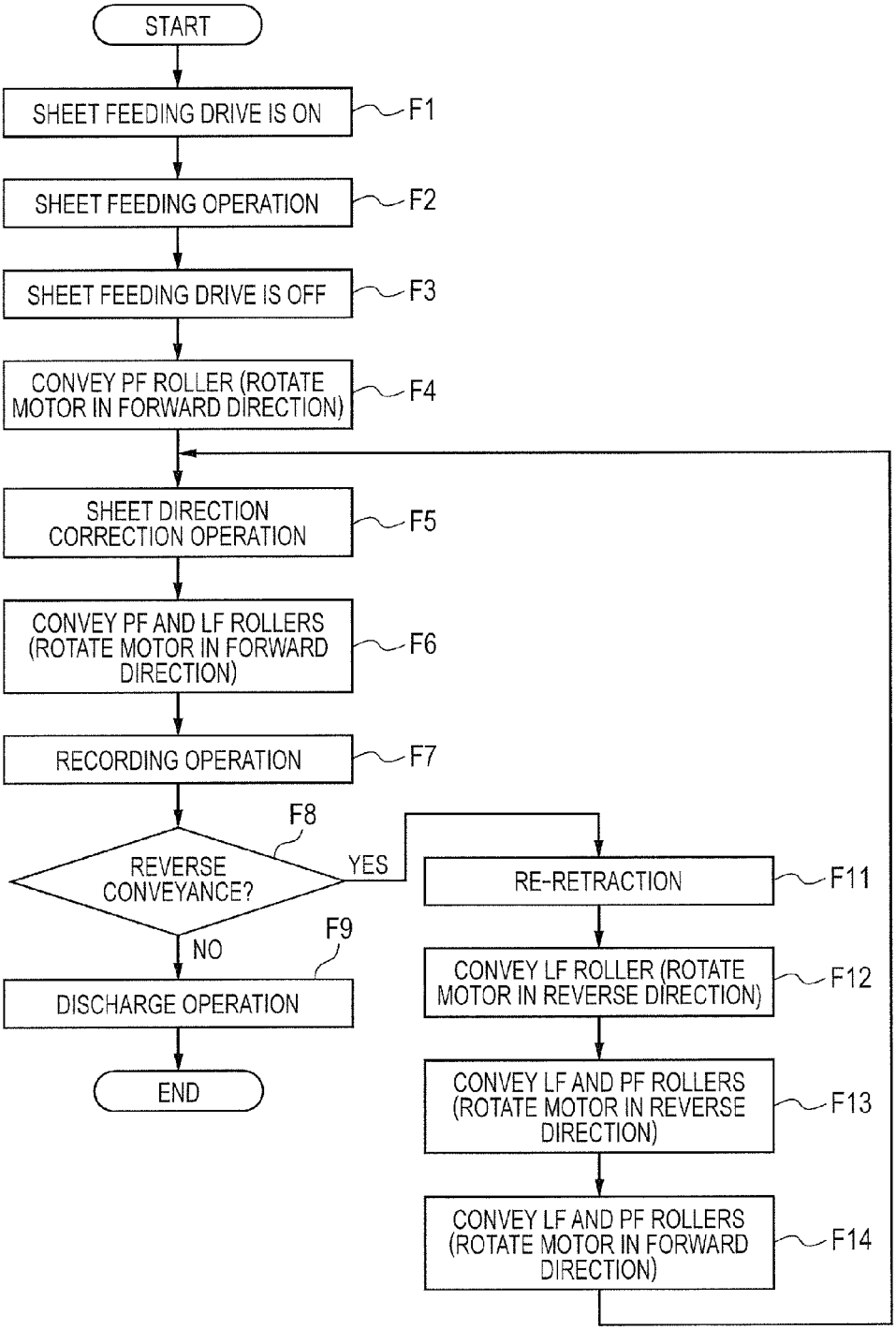
FIG. 7 is a flowchart showing an outline of a conveying operation of the conveying apparatus to which the present invention is applied.
Figure 8:
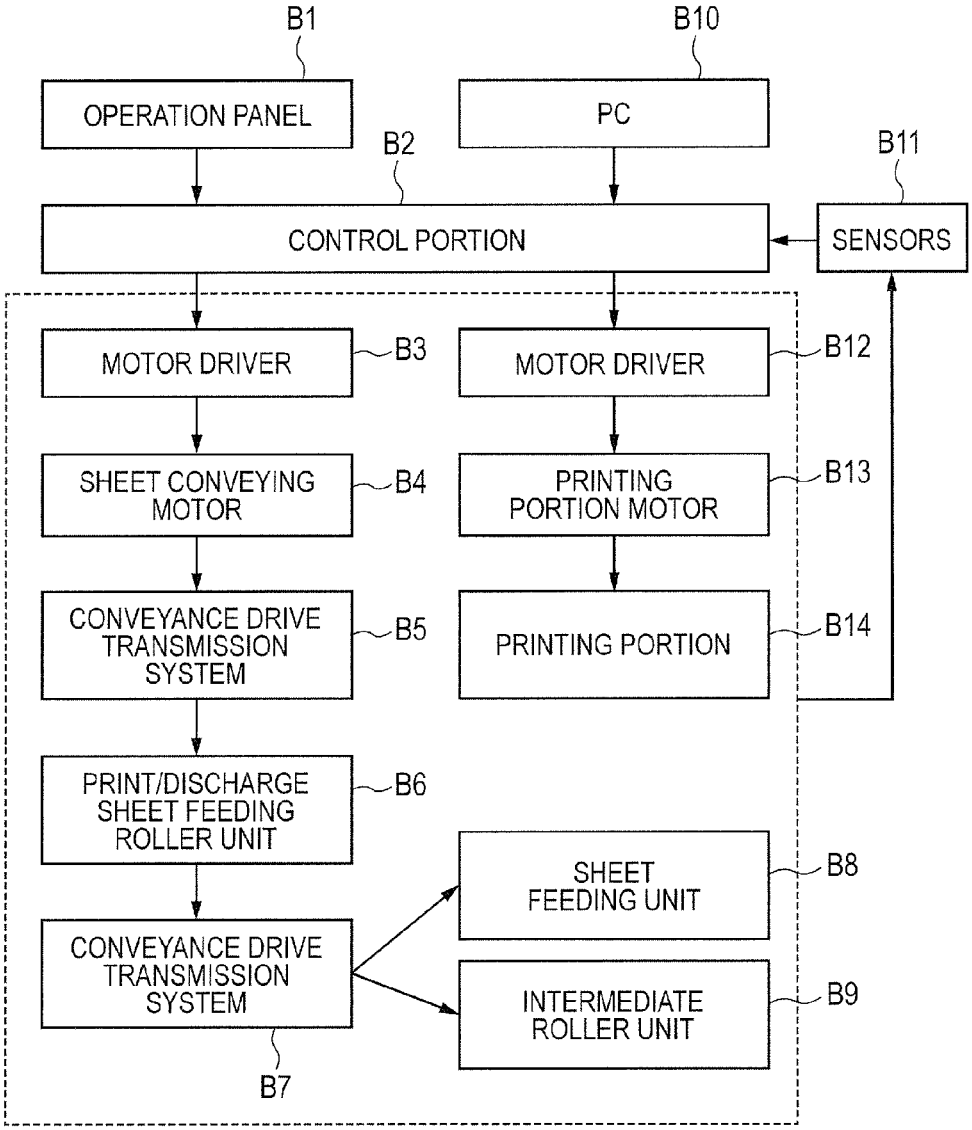
FIG. 8 is a block diagram showing an outline of a control apparatus in the conveying apparatus to which the present invention.

Preferred embodiments of the present invention will now be described in detail in accordance with the accompanying drawings. It is to be noted that like reference numerals denote like or corresponding parts throughout the drawings. FIG. 2 is a longitudinal cross-sectional view showing an embodiment of a paper sheet conveying apparatus to which the present invention is applied, FIG. 7 is a flowchart for explaining a conveying operation of this apparatus, and FIG. 8 is a block diagram showing an outline of a control apparatus of this apparatus. It is to be noted that the conveying apparatus according to the present invention shown in FIGS. 2, 7, and 8 as an embodiment is not restricted to a conveying apparatus that conveys a paper sheet as a recording medium on which an image is recorded by a recording head based on image information in a recording apparatus such as a printer or a printing machine. The conveying apparatus according to the present invention can be likewise applied to various conveying apparatuses configured to convey a paper sheet or a manuscript, e.g., a conveying apparatus that conveys a sheet as a manuscript from which an image is read in an image read apparatus such as a facsimile or a scanner. The sheet to be conveyed is not restricted to the paper sheet.

Figure 1A:
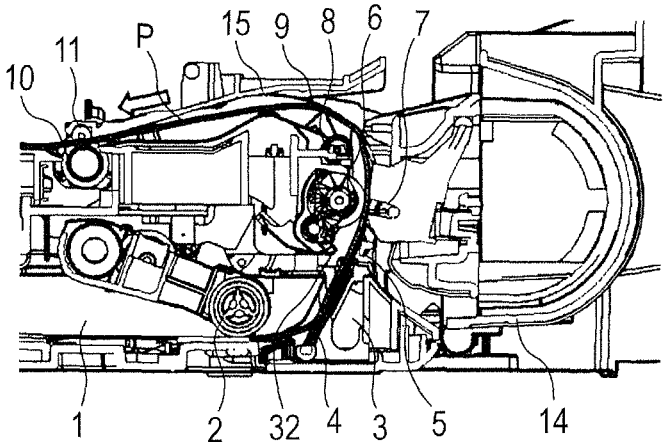
FIG. 1A and FIG. 1B are longitudinal cross-sectional views showing an embodiment of a conveying apparatus to which the present invention is applied, where

An operation of the conveying apparatus when performing recording on one side of a paper sheet P will now be described step by step with reference to FIG. 2 and a flowchart depicted in FIG. 7. In FIG. 2, when sheet feeding drive begins (a step F1), the paper sheets P mounted in a sheet loading portion 1 are fed by a sheet feeding roller 2 (a step F2), and they are separated one by one by sheet separating means 4 disposed on the upper portion of a separation bank 3. A first sorting member 5 that moves to sort conveying directions of the sheets is disposed on the separation bank 3. The first sorting member 5 is configured to be placed at such a regular path conveying position as depicted in FIG. 1A by its own weight. The separated paper sheet P is fed to a first conveying path (which will be also referred to as a regular path hereinafter) by the first sorting member 5 (see also FIG. 1A). The regular path is a portion where the sheet P is drawn in FIG. 1A, and it is preferable for the regular path to curve in a U-like shape. The paper sheet P fed to the regular path is supplied to a nip portion including a swing arm type PF (paper feed) roller 6 and a PF pinch roller 7 which is a pinch roller that is driven by the PF roller 6. The nip portion is a portion where the PF roller 6 and the PF pinch roller 7 are welded with pressure. The pinch roller rotates by frictional force of a corresponding roller or a paper sheet that is being conveyed. Here, a roller pair consisting of the PF roller 6 and the PF pinch roller 7 will be referred to as an intermediate roller pair (a second conveying roller pair). In the regular path, the paper sheet P is conveyed in such a manner that a later-described conveying roller pair 10, 11 is placed on the downstream of the intermediate roller pair 6, 7.

Figure 1B:
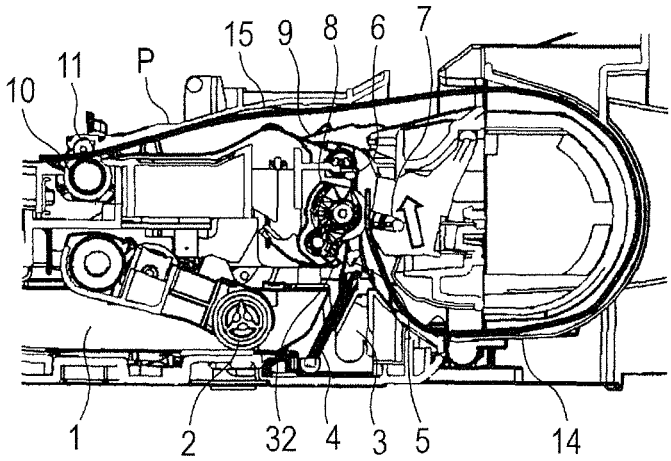
Figure 3:
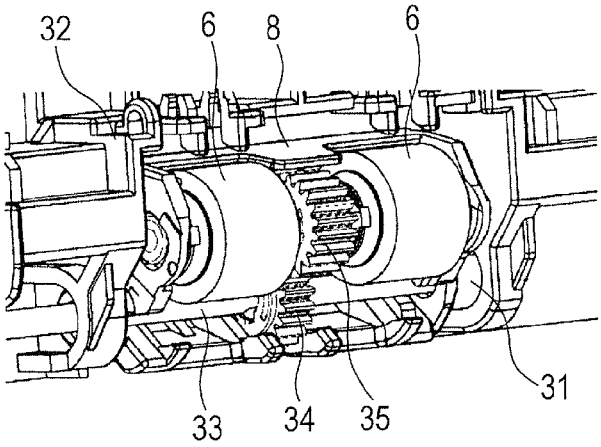
FIG. 3 is a schematic perspective view showing particulars of a swing arm type PF roller depicted in FIG. 2.

FIG. 3 is a view showing particulars of the swing arm type PF roller 6. The swing arm type PF roller 6 is held by a swingably configured swing arm 8. The swing arm 8 swings the PF roller 6 in such a manner that force for nipping the paper sheet P by the intermediate roller pair is decreased in accordance with a reduction in conveying resistance received from the paper sheet P. That is, when a portion of the paper sheet P provided on the downstream of the intermediate roller pair that is conveying the paper sheet P is pulled at a higher velocity than a circumferential velocity of the intermediate roller pair, the swing arm 8 swings the PF roller 6. A swing shaft member 31 serving as a swing shaft of the swing arm 8 is supported by a bearing portion of a swing arm support member 32 so as to allow a rotary movement. Further, to transmit driving to the PF roller 6, a PF roller shaft 33, a PF input gear 34, a gear 35 that is arranged on the same shaft as a rotary shaft of the PF roller 6 are held by the swing arm 8. After the paper sheet P is nipped by the PF roller 6 and the PF pinch roller 7, driving of the sheet feeding roller 2 is stopped (a step F3). Then, the paper sheet P is conveyed by the PF roller 6 (a step F4). A second sorting member 9 is configured to be placed at such a reversing path conveying position as depicted in FIG. 1B by its own weight. An end of the paper sheet P that is being conveyed by the PF roller 6 is continuously conveyed through the regular path by pushing up the second sorting member 9 to the regular path conveying position. Subsequently, the paper sheet P is fed to a nip portion including an LF (line feed) roller 10 and an LF pinch roller 11 which is driven by the LF roller 10. A roller pair consisting of the LF roller 10 and the LF pinch roller 11 will be referred to as a conveying roller pair (a first conveying roller pair) hereinafter. The end of the paper sheet P that is being conveyed by the intermediate roller pair is aligned along the nip portion (a nip line) of the conveying roller pair, which is currently stopped or rotated in the reverse direction, by the intermediate roller pair, thereby effecting a paper sheet direction correction operation for correcting a skew of the paper sheet (a step F5). Then, the paper sheet P is conveyed to a lower portion of recording means (not shown) provided in the recording apparatus by the PF roller 6 and the LF roller 10 (a step F6). In this example, a velocity relationship between a circumferential velocity $V_a$ of the LF roller 10 and a circumferential velocity $V_b$ of the PF roller 6 at this moment is $|V_b|=|V_a|\times 0.66$, and the circumferential velocity $|V_a|$ of the LF roller 10 is set to be higher. When the circumferential velocity of the LF roller 10 is increased in this manner, conveying resistance applied to the swing arm type PF roller 6 is reduced or eliminated. As a result, the PF roller 6 swings to decrease the nipping force for the paper sheet that is nipped by the PF roller 6 and the PF pinch roller 7. Therefore, distortion which occurs in the paper sheet when correcting the skew of the paper sheet P can be eliminated in a paper sheet conveying process using the LF roller 10, and the paper sheet P can be prevented from again skewing after correcting the distortion. Furthermore, since the circumferential velocity $|V_a|$ of the LF roller 10 corresponding to the downstream of the conveying direction is higher, it is possible to avoid a problem, i.e., the paper sheet P buckles and a skew or a jam occurs. It is to be noted that the circumferential velocity of the LF pinch roller 11 is equal to the circumferential velocity of the LF roller 10 and the circumferential velocity of the LF pinch roller 11 is equal to the circumferential velocity of the LF roller 10. Then, a recording operation is performed by the recording means as required (a step F7). When performing recording on one side of the paper sheet alone, the paper sheet P is thereafter discharged to the outside of the apparatus main body by a sheet ejection roller 12 and a spur 13 (a step F9).

An operation when likewise performing printing on a back side of the paper sheet P will now be described step by step. A process that the paper sheet P is fed from the sheet loading portion 1 to the recording portion in FIG. 2 and recording is carried on the front side of the paper sheet P (the steps F1 to F7) is the same as the above-described operation. When performing recording on the back side of the paper sheet P, the paper sheet P is not discharged by the sheet ejection roller 12 after end of the recording on the front side of the paper sheet P. The sheet ejection roller 12 rotates in the reverse direction and again feeds the paper sheet P into the apparatus main body (a step F11). The paper sheet P fed by the sheet ejection roller 12 is nipped by the LF roller 10 and the LF pinch roller 11. Then, the paper sheet P conveyed by the LF roller 10 (a step F12) is fed to a second conveying path (a reversing path) by the second sorting member 9 placed at the reversing path conveying position by its own weight as shown in FIG. 1B. In this embodiment, the reversing path is a portion where the sheet P is drawn in FIG. 1B, and it has a curved portion that is curved in an arc shape between the LF roller 10 and the PF roller 6. A wall surface on an outer peripheral side of the curved portion is constituted of a reversing path outer guide member 14. In the reversing path, the paper sheet P is conveyed in such a manner that the conveying roller pair 10, 11 is placed on the upstream of the intermediate roller pair 6, 7. The paper sheet P is conveyed along the reversing path outer guide member 14 and a reversing path conveying surface of the separation bank 13 and reaches the first sorting member 5. Although the first sorting member 5 is configured to be placed at the U-turn path conveying position by its own weight, when the end of the paper sheet P pushes the first sorting member 5 as shown in FIG. 1B, the first sorting member 5 is switched to the reversing path conveying position. Thereafter, the end of the paper sheet P is again nipped by the PP roller 6 and the PF pinch roller 7. The velocity relationship between the circumferential velocity $V_a$ of the LF roller 10 and the circumferential velocity $V_b$ of the PF roller 6 at this moment is $|V_a|\leq|V_b|$. As a result, it is possible to avoid a problem that may occur when the circumferential velocity $|V_b|$ of the PF roller 6 is lower than $|V_a|$, i.e., a problem that the paper sheet P adheres to the reversing path outer guide member 14 of the reversing path and then buckles and a skew or a jam occurs.

The sorting members 5 and 9 are provided in a coupling portion that couples the regular path (the first conveying path) with the reversing path (the second conveying path). The sorting members 5 and 9 are moved in such a manner that the paper sheets are supplied to one of the first conveying path and the second conveying path by pressing force from the paper sheet P that is being conveyed.

Furthermore, it is preferable for the circumferential velocity |Vb| of the PF roller 6 to be not too high with respect to the circumferential velocity $|V_a|$ of the LF roller 10. In the reversing path, the end of the paper sheet P adheres to the wall surface on the outer peripheral side of the reversing path and conveyed in this state until it is nipped by the PF roller 6 and the PF pinch roller 7. However, when the circumferential velocity $|V_b|$ of the PF roller 6 is extremely higher than the circumferential velocity $|V_a|$ of the LF roller 10, the end of the paper sheet P is nipped by the PF roller 6 and the PF pinch roller 7 and then pulled, and hence an intermediate portion or a rear portion of the paper sheet P eventually adheres to the wall surface on the inner peripheral side of the reversing path. In this case, the PF roller 6 must forcibly pull the paper sheet P so as to slip a point of the paper sheet P nipped by the LF roller 10 and the LF pinch roller 11. Therefore, the PF roller 6 is hard to convey the paper sheet, and there may possibly occur a problem that an excessive load is applied to a motor or the point of the paper sheet P nipped by the PF roller 6 and the PF pinch roller 7 slips. To avoid occurrence of this problem, it is preferable to impose a predetermined condition to the circumferential velocities of the LF roller 10 and the LF pinch roller 11 (the conveying roller pair) and those of the PF roller 6 and the PF pinch roller 7 (the intermediate roller pair). That is, as the condition, a time from the moment that the end of the paper sheet P that adheres to the wall surface on the outer peripheral side of the reversing path and is conveyed in this state is nipped by the intermediate roller pair to the moment that the rear end of the paper sheet P gets out of the conveying roller pair is shorter than a time from the moment that deflection of the paper sheet P is eliminated to the moment that the paper sheet adheres to the wall surface on the inner peripheral side of the reversing path. This condition is represented by the following Expression 1:

$$\frac{(L_{out}-L_{in})}{|V_b-V_a|}\geq\frac{l_{max}-L_{out}}{|V_a|} \qquad \text{[Expression 1]}$$

Here, $l_{max}$ is a length of the paper sheet P having a maximum length that is conveyed by the conveying apparatus. $L_{out}$ is a distance from the conveying roller pair 10, 11 to the intermediate roller pair 6, 7 that is measured along the wall surface on the outer peripheral side of the reversing path. $L_{in}$ is a distance from the conveying roller pair 10, 11 to the intermediate roller pair 6, 7 that is measured along the wall surface on the inner peripheral side of the reversing path. It is to be noted that a start point and an end point of each of these distances are specified based on the point of the paper sheet P nipped by each roller pair. The left side of the above expression represents a time required for the rear end of the paper sheet P to get out of the LF roller 10 and the LF pinch roller 11 from the time point that the PF roller 6 and the LF pinch roller 7 nip the end of the paper sheet P having the maximum length. The right side of the above expression represents a time required for the deflection of the power sheet P to be eliminated and the paper sheet P to adhere to the wall surface on the inner peripheral surface from the time point that the PF roller 6 and the PF pinch roller 7 nip the end of the paper sheet P having the maximum length. When this expression is converted into a condition that should be met by $V_b$, it can be written like the following Expression 2:

$$|V_a| \le |V_b| \le (L_{out} - L_{in}) \times \frac{|V_a|}{(l_{max} - L_{out})} + |V_a| \quad \text{[Expression 2]}$$

It is to be noted that the LF roller 10 rotates in the opposite directions when conveying through the regular path and when conveying through the reversing path, this movement is taken into consideration, and absolute values are given to $V_a$ and $V_b$ in the above relational expression. Here, since the LF roller 10 and the PF roller 6 are adjusted to meet the above condition, it is possible to eliminate the problem that an excessive load is applied to the motor or the point of the paper sheet P nipped by the PF roller 6 and the PF pinch roller 7 slips.

Thereafter, the front end of the paper sheet P is nipped by the PF roller 6 and the PF pinch roller 7, the rear end of the paper sheet P is nipped by the LF roller 10 and the LF pinch roller 11, and conveyance is carried out in this state (a step F13). When the front end of the paper sheet P pushes up the second sorting member 9 to the U-turn path conveying position, the paper sheet P is continuously conveyed through the U-turn path. Even in case of the longest sheet size compliant with the conveying apparatus, conveyance is performed until the rear end of the paper sheet P sufficiently get out of the LF roller 10 and the LF pinch roller 11, and then the LF roller 10 is again switched to rotation in the forward direction (a step F14). Subsequently, the front end of the paper sheet P is fed toward the LF roller 10, and the paper sheet direction correction operation (the step F5) is performed. Thereafter, the paper sheet P is conveyed to the lower side of the recording means arranged on the downstream of the LF roller 10, and it is preferable for the circumferential velocity $|V_a|$ of the LF roller 10 to be higher than the circumferential direction $|V_b|$ of the PF roller 6 at this moment. Here, $|V_b|=|V_a|\times 0.66$ is set, and the circumferential velocity $|V_a|$ of the LF roller 10 is set to be higher. It is to be noted that this velocity relationship is just an example, and the circumferential velocity is not restricted to this set value. Then, the recording means carries out the recording operation, and the paper sheet P subjected to the recording is ejected to the outside of the apparatus main body by the paper ejection roller 12 and the spur 13.

Figure 4:
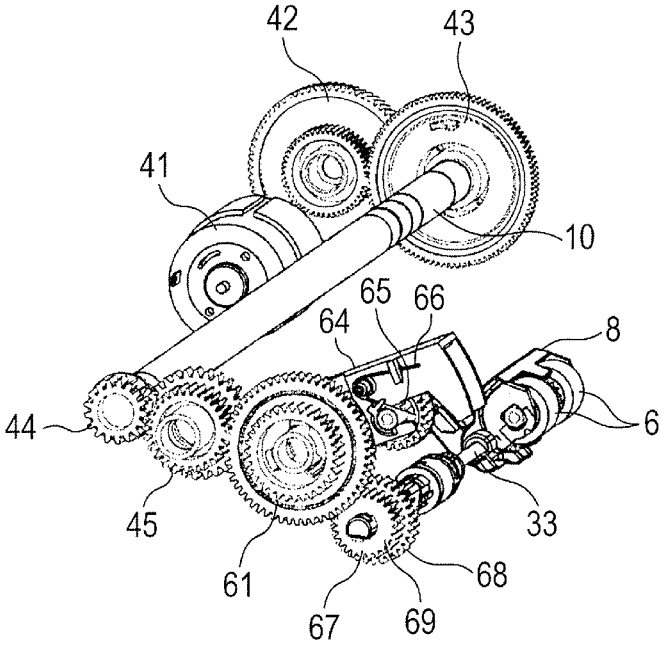
FIG. 4 is a perspective view schematically showing a drive gear train in the conveying apparatus to which the present invention is applied.
Figure 5:
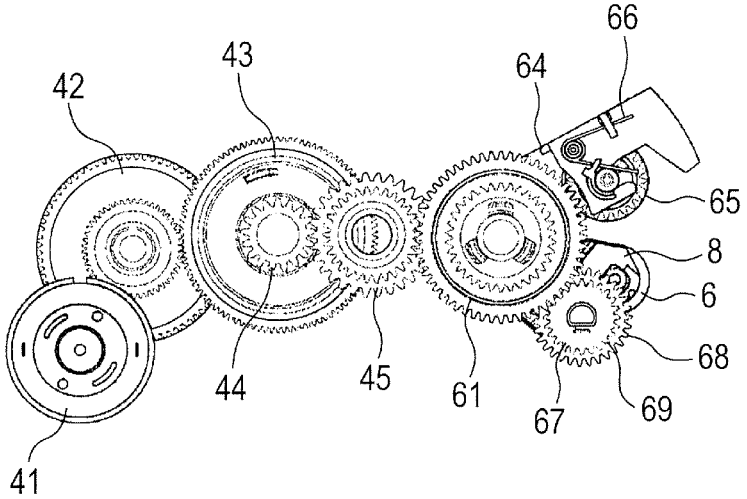
FIG. 5 is a side elevation schematically showing the drive gear train in the conveying apparatus to which the present invention is applied.
Figure 6:
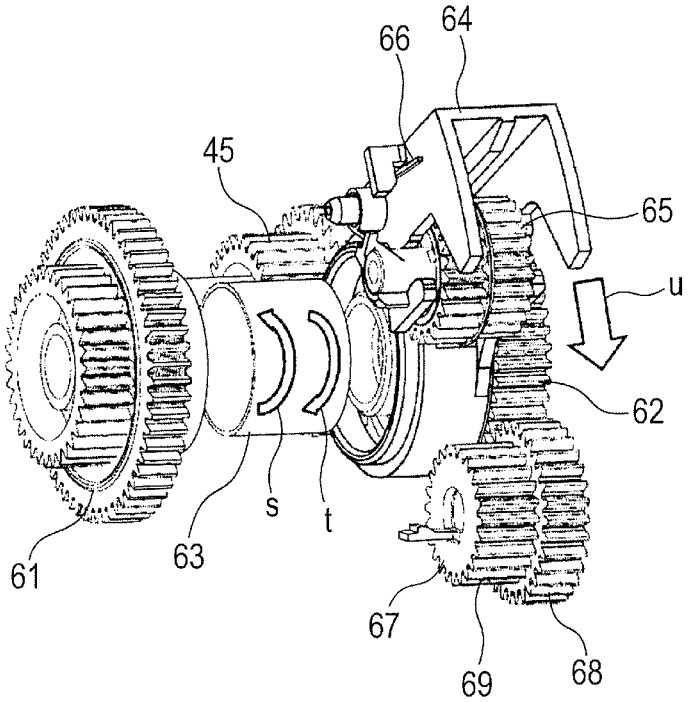
FIG. 6 is a schematic perspective view showing a configuration of a clutch gear depicted in FIGS. 4 and 5.

A configuration of a drive gear train that transmits driving from a conveying motor 41 to the LF roller 10 and the PF roller 6 will now be described. In view of miniaturization and a reduction in cost, it is preferable for the conveying roller pair 10, 11 and the intermediate roller pair 6, 7 to be driven by a single motor. FIG. 4 shows a schematic perspective view of the drive gear train, and FIG. 5 shows a side elevation of the same. A motor gear (not shown) is coupled with an LF input gear 43 disposed at one end portion of the LF roller 10 through an idler gear 42. A code wheel (not shown) having markings formed thereon for detecting rotation of the motor is disposed to the LF input gear 43, this code wheel is read by an encoder sensor (not shown), and the rotation of the LF roller 10 is controlled. An LF output gear 44 is disposed at the other end portion of the LF roller 10, and driving is transmitted from this LF output gear 44 to a sun gear 61 through an idler gear 45. The sun gear 61 is configured as a clutch gear. That is, as shown in FIG. 6, a spring 63 is disposed in the sun gear 61 and a sun gear 62. When the sun gear 61 rotates in the forward direction (a direction of an arrow s in FIG. 6), the spring 63 is fastened, and the sun gear 61 and the sun gear 62 rotate in cooperation with each other. When the sun gear 61 rotates in the reverse direction (a direction of an arrow t in FIG. 6), the spring 63 is opened, and hence the sun gear 61 and the sun gear 62 slide and do not rotate in cooperation with each other upon application of a load to the sun gear 62. Moreover, a swing arm 64 is provided on a shaft of the sun gear 61, and a planet gear 65 is disposed to the swing arm 64. A swing arm spring 66 is provided between the planet gear 65 and the swing arm 64, and the swing arm 64 also rotates (swings) when the sun gear 61 rotates by friction. A stage 68 of a multistage gear 67 is coupled with the sun gear 62. Additionally, a stage 69 of the multistage gear 67 is set at a position where it can be coupled with the planet gear 65. With these structures, when the sun gear 61 rotates in the forward direction, driving input to the sun gear 61 is transmitted to the stage 68 of the multistage gear 67 through the sun gear 62 that rotates with the sun gear 61. When the sun gear 61 rotates in the reverse direction, the swing arm 64 moves in the direction of the arrow u in FIG. 6, the planet gear 65 is coupled with the stage 69 of the multistage gear 67, and driving is transmitted to the multistage gear 67. It is to be noted that, since the sun gear 62 is the clutch gear, the sun gears 61 and 62 slide and do not obstruct driving when the sun gear 61 rotates in the reverse direction. According to such a transmission method of driving force, in both rotation in the forward direction and rotation in the reverse direction of the sun gear 61, a rotating direction of the multistage gear 67 remains the same. Further, a reduction gear ratio differs depending on a case that transmission is performed through the sun gear 62 and the stage 68 of the multistage gear 67 and a case that transmission is performed through the planet gear 65 and the stage 69 of the multistage gear 67, and the relationship between the circumferential velocity $V_a$ of the LF roller 10 and the circumferential velocity $V_b$ of the PF roller 6 can be adjusted. The above example has a configuration that $|V_b|=|V_a|\times 0.66$ is achieved when the former is used for driving and that $|V_b|=|V_a|$ is achieved when the latter is used for driving. The PF roller shaft 33 is provided on a shaft of the multistage gear 67, and the PF input gear 34 is arranged at the other end portion of the PF roller shaft 33. Driving is transmitted to the PF input gear 34 and the gear 35 arranged on the same shaft as the PF roller 6, and the PF roller 6 is thereby rotated. It is to be noted that two drive gear train systems, each drive gear train of which includes the LF roller 10 to the PF roller 6, are provided and a reduction gear ratio of each drive gear train is changed by the clutch gear and the swing arm 64 in this configuration. The first drive gear train and the second drive gear train are configured to be switchable. When the drive gear trains are switched, even the single motor can switch the circumferential velocity of at least one of the PF roller 6 and the LF roller 10. It is to be noted that this is just an example and the configuration of the drive gear train according to the present invention is not restricted.

An outline of the control apparatus of the conveying apparatus will now be described with reference to FIG. 8. The control apparatus is constituted mainly based on a control portion B2. The control portion B2 outputs a motor current control signal to motor drivers B3 and B12 in accordance with an input from an operation panel B1 or a personal computer (PC) B10 connected to the conveying apparatus. A sheet conveying motor B4 (the motor 41) drives a printing/discharge sheet feeding roller unit B6, a sheet feeding roller unit B8, and an intermediate roller unit B9 through conveyance drive transmission systems B5 and B7 in accordance with a signal input from the motor driver B3. Further, a printing portion motor B13 drives a printing portion B14 in accordance with a signal input from a motor driver B12. Various sensors B11 provided in the sheet conveying portion or the printing portion are used to sense a printing position of the printing portion and others, and a signal is input to the control portion B2, whereby appropriate control signals are again output to the motor drivers B3 and B12.

As shown in FIG. 1A and FIG. 1B, the conveying apparatus has an abutting member 32 that abuts on the first sorting member 5 and restricts a movable range of the first sorting member 5 and an abutting member 15 that abuts on the second sorting member 9 and restricts a movable range of the second sorting member 9. A driving source for electrical control may not be provided for such a sorting member in a product demanding miniaturization and a reduction in cost. In such a case, there is adopted a configuration that the sorting member moves to open the path by pressing force from the paper sheet that is being conveyed when passing through a given conveying path and that the path is closed by the sorting member's own weight or a spring pressure when passing through another path. However, in such a configuration, the sorting member's own weight or the spring pressure that enables moving the sorting member by pressing force (reactive force) of the paper sheet is set, and hence the sorting member moves with relatively small force. Therefore, when the sorting member is electrically charged due to friction with the paper sheet, a state that the sorting member moves, namely, a phenomenon that the path is not restored from the opened state may possibly occur due to electrostatic force. When this phenomenon occurs, at the time of conveying a subsequent paper sheet, the paper sheet cannot be normally conveyed, which may possibly causes a jam. To solve this problem, there are provided a movable member that is moved by pressing force from the sheet that is being conveyed and the abutting members that abut on the movable member to restrict the movable range of the movable member. For example, in this embodiment, these abutting members 9 and 15 have surfaces on which the sorting members 5 and 9 abut when the sorting members 5 and 9 are moved by the paper sheet P. It is preferable for each of the first sorting member 5, the abutting member 32, the second sorting member 9, and the abutting member 15 to be a member made of polystyrene. It is known that polystyrene is on a lower level in a triboelectric series as compared with the paper sheet P, and polystyrene carries negative electric charges due to friction with the paper sheet. Since all of the four members 5, 9, 15, and 32 carry negative electric charges, repulsive force acts when the sorting members 5 and 9 are opened, and the phenomenon that the opened state cannot be restored to the original state by attraction force due to static electricity does not occur. It is to be noted that the four members 5, 9, 15, and 32 are all made of polystyrene in this example, but any material can be used as long as it can meet conditions that the sorting members 5 and 9 and the associated abutting members 15 and 32 are all on the higher level than the paper sheet in the electrically-charged series. As a result, the same effect can be obtained.

It is to be noted that the description has been given as to the material of the sorting members 5 and 9 that move to sort the conveying paths for the paper sheet P as a sheet in the foregoing embodiment. Selection of a material considering the electrically-charged series in this manner can be applied to general conveying apparatuses each comprising the movable member that moves based on pressing force from the paper sheet P that is being conveyed and the abutting members that abut on the movable member to restrict the movable range of the movable member. According to the above-described configuration, when the movable member is moved based on the pressing force from the paper sheet that is being conveyed, it is possible to avoid a situation that the movable member cannot be restored to the original state by the electrostatic force.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-177862, filed Aug. 16, 2011, which is hereby incorporated by reference herein in its entirety.

What is claimed is:

1. A conveying apparatus comprising:

a first conveying roller pair which rotates while nipping a sheet and conveys the sheet;

a second conveying roller pair which rotates while nipping the sheet and conveys the sheet;

a first conveying path through which the sheet is conveyed in such a manner that the first conveying roller pair is placed downstream of the second conveying roller pair;

a second conveying path through which the sheet is conveyed in such a manner that the first conveying roller pair is placed upstream of the second conveying roller pair; and a holding unit configured to hold one of the second conveying roller pair so that a nipping force is reduced in accordance with a force received from the sheet being conveyed by the first conveying unit when the sheet is conveyed through the first conveying path;

wherein a circumferential velocity of at least one of the first conveying roller pair and the second conveying roller pair is switched so as to meet conditions $|V_a|>|V_b|$ when the sheet is conveyed through the first conveying path and $|V_a|\leq|V_b|$ when the sheet is conveyed through the second conveying path, where $|V_a|$ is an absolute value of the circumferential velocity of the first conveying roller pair and $|V_b|$ is an absolute value of the circumferential velocity of the second conveying roller pair.

2. The conveying apparatus according to claim 1, wherein the first conveying roller pair and the second conveying roller pair are driven by a single motor.

3. The conveying apparatus according to claim 2, further comprising: a first drive gear train that transmits driving from the motor to one roller constituting the second conveying roller pair; and a second drive gear train that transmits driving from the motor to the one roller constituting the second conveying roller pair and has a reduction gear ratio different from that of the first drive gear train, the first drive gear train and the second drive gear train being configured to be switchable.

4. The conveying apparatus according to claim 1, wherein the holding unit comprises a swing arm that swingably holds one roller of the second conveying roller pair, wherein the swing arm swings the one roller so as to reduce the force for nipping the sheet by the second conveying roller pair in accordance with force received from the sheet being conveyed by the first conveying unit when the sheet is conveyed through the first conveying path.

5. The conveying apparatus according to claim 1, wherein the second conveying path has a portion that is curved in an arc-like shape between the first conveying roller pair and the second conveying roller pair, and when the sheet is conveyed through the second conveying path by the first conveying roller pair and the second conveying roller pair, the circumferential velocities of the first conveying roller pair and the second conveying roller pair meet a condition of the following expression:

$$|V_a| \leq |V_v| \leq (L_{out} - L_{in}) \times \frac{|V_a|}{(l_{max} - L_{out})} + |V_a|$$

where $l_{max}$ is the longest length of the sheet compliant with the conveying apparatus, $L_{out}$ is a distance from the first conveying roller pair to the second conveying roller pair when measured along a wall surface on the outer periphery side of the second conveying path, and $L_{in}$ is a distance from the first conveying roller pair to the second conveying roller pair when measured along a wall surface on the inner periphery side of the second conveying path.

6. The conveying apparatus according to claim 1, further comprising:

a sorting member that is provided in a coupling portion that couples the first conveying path with the second conveying path and moved to feed the sheet to one of the first conveying path and the second conveying path by pressing force from the sheet that is being conveyed; and an abutting member that abuts the sorting member to restrict a movable range of the sorting member, wherein the sorting member and the abutting member are made of materials both of which are on an upper level or a lower level than the sheet in a electrically-charged series.

7. A recording apparatus comprising:

a recording portion configured to perform a recording operation to record an image on a recording medium;

a first conveying roller provided upstream of the recording portion with respect to a conveying direction of the recording medium when the recording operation is executed, the first conveying roller conveying the recording medium and rotating in a first direction when the recording operation is executed;

a conveying motor for driving the first conveying roller;

a second conveying roller provided upstream of the first conveying roller with respect to the conveying direction of the recording medium when the recording operation is executed, the second conveying roller conveying the recording medium and being driven by the conveying motor;

a reverse route for reversing the recording medium, the first roller rotating in a second direction so that the recording medium is conveyed to the reverse route; and a drive transmitting mechanism for transmitting a driving force from the conveying motor to the first conveying roller and the second conveying roller, the drive transmitting mechanism causing the second conveying roller to rotate in a speed lower than the first conveying roller when the recording operation is executed and causing the second conveying roller to rotate in a speed higher than or equal to the first conveying roller when the recording medium is conveyed in the reverse route.

8. The recording apparatus according to claim 7, wherein the second conveying roller is located in the reverse route.

9. The recording apparatus according to claim 7, wherein the second conveying roller rotates in the first direction when the recording operation is executed and when the recording medium is conveyed in the reverse route.

10. The recording apparatus according to claim 7, further comprising a first pinch roller biased by the first conveying roller to pinch and convey the recording medium with the first conveying roller.

11. The recording apparatus according to claim 10, further comprising a second pinch roller biased by the second conveying roller to pinch and convey the recording medium with the second conveying roller.

12. The recording apparatus according to claim 11, further comprising a swing arm for swingably holding the second conveying roller, wherein the swing arm rotates so that the second conveying roller is movable to a position in which the swing arm is in contact with the second pinch roller and a position in which the swing arm is remote from the second pinch roller.

* * * * *